US007640920B2

(12) United States Patent
Makino

(10) Patent No.: US 7,640,920 B2
(45) Date of Patent: Jan. 5, 2010

(54) FUEL VAPOR PROCESSING APPARATUS

(75) Inventor: Katsuhiko Makino, Aichi-ken (JP)

(73) Assignee: Aisan Kogyo Kabushiki Kaisha, Obi-Shi, Aichi-Ken (JP)

( * ) Notice: Subject to any disclaimer, the term of this patent is extended or adjusted under 35 U.S.C. 154(b) by 0 days.

(21) Appl. No.: 12/237,680

(22) Filed: Sep. 25, 2008

(65) Prior Publication Data

US 2009/0107472 A1 Apr. 30, 2009

(30) Foreign Application Priority Data

Oct. 25, 2007 (JP) ..... 2007-277477

(51) Int. Cl.
*F02M 33/04* (2006.01)
*F02M 33/02* (2006.01)

(52) U.S. Cl. ..... 123/520

(58) Field of Classification Search ..... 123/520, 123/519, 518, 516, 198 D; 137/587, 588, 137/589, 43, 493
See application file for complete search history.

(56) References Cited

U.S. PATENT DOCUMENTS 5,056,494 A * 10/1991 Kayanuma ..... 123/519
5,143,041 A * 9/1992 Franzke ..... 123/520
5,564,398 A * 10/1996 Maeda et al. ..... 123/520
5,592,922 A * 1/1997 Denz ..... 123/520
5,632,252 A * 5/1997 Hyodo et al. ..... 123/520

FOREIGN PATENT DOCUMENTS

| | | |
|---|---|---|
| JP | 48756 | 1/1992 |
| JP | 674107 | 3/1994 |
| JP | 2001165010 | 6/2001 |
| JP | 2002004956 | 1/2002 |
| JP | 2004263652 | 9/2004 |

* cited by examiner

*Primary Examiner*—Mahmoud Gimie
(74) *Attorney, Agent, or Firm*—Dennison, Schultz & MacDonald

(57) ABSTRACT

The present invention includes a first canister disposed within an intake air passage. The first canister communicates with a fuel tank via a second canister, so that a fuel vapor produced within the fuel tank can be purged by the second canister and further by the first canister. The second canister communicates with the intake air passage via a purge passage. The negative pressure within the intake air passage may be applied to the first and second canisters via the purge passage, so that the fuel vapor adsorbed by the first and second canisters can be desorbed or purged and can then be returned into the intake air passage.

18 Claims, 4 Drawing Sheets

FUEL VAPOR PROCESSING APPARATUS

This application claims priority to Japanese patent application serial number 2007-277477, the contents of which are incorporated herein by reference.

BACKGROUND OF THE INVENTION

1. Field of the Invention

The present invention relates to fuel vapor processing apparatus for processing fuel vapor that may be produced within a fuel tank.

2. Description of the Related Art

A known fuel vapor processing apparatus is disclosed, for example, in Japanese Laid-Open Patent Publication No. 6-74107. The fuel vapor processing apparatus of this known publication is shown in FIG. 5 and includes a main canister 101 and a sub canister 103 connected in series with each other via a throttle 102. The main canister 101 communicates with an upper chamber of a fuel tank T via a fuel vapor passage 105 on one hand, and communicates with an intake air passage 108 of an engine E via a purge passage 106 and a control valve 107 on the other hand. The sub canister 103 is open into the atmosphere via an atmospheric port 103*p*.

When the engine E is not started and is stopped, the control valve 107 is closed, and fuel vapor produced within the fuel tank T is introduced into the main canister 101 via the fuel vapor passage 105 so as to be adsorbed by an adsorption material K contained within the main canister 101. A part of the fuel vapor that has not been adsorbed within the main canister 101 is introduced into the sub canister 103 via the throttle 102 so as to be adsorbed by an adsorption material K contained within the sub canister 103. Therefore, the fuel vapor is prevented from dissipating into the atmosphere.

On the other hand, during the operation of the engine E, the control valve 107 is opened, so that a negative pressure within the intake air passage 108 is applied to the sub canister 103 via the main canister 101. Therefore, external air may enter the sub canister 103 via the atmospheric port 103*p*, so that the fuel vapor adsorbed by the adsorption material K within the sub canister 103 can be purged. In addition, the air that may flow into the main canister 101 via the throttle 102 can purge the fuel vapor adsorbed by the adsorption material K within the main canister 101. With the air flowing into the main canister 101, the purged fuel vapor is introduced into the intake air passage 108 via the purge passage 106.

According to the known fuel vapor processing apparatus, the fuel vapor adsorbed within the sub canister 103 is purged by the air that enters the sub canister 103 via the atmospheric port 103*p* and subsequently flows through the main canister 101 and the control valve 107. Therefore, if the control valve 107 is operated in a closing direction, for example, due to the control of the air-fuel ratio, during the operation of the engine E, the flow rate of the air entering the sub canister 103 via the atmospheric port 103*p* may be decreased. Hence, there is a possibility that the purging of the fuel vapor from within the sub canister 103 may not be effectively performed.

If the amount of the fuel vapor remaining within the sub canister 103 increases, there is a possibility that the fuel vapor is dissipated to the atmosphere via the atmospheric port 103*p* of the sub canister 103 when the engine E has stopped.

Therefore, there is a need in the art for fuel vapor processing apparatus that can prevent or minimize dissipation of fuel vapor into the atmosphere.

SUMMARY OF THE INVENTION

One aspect according to the present invention includes a first canister disposed within an intake air passage. The first canister communicates with a fuel tank via a second canister, so that a fuel vapor produced within the fuel tank can be adsorbed by the second canister and further by the first canister. The second canister communicates with the intake air passage via a purge passage. The negative pressure within the intake air passage may be applied to the first and second canisters via the purge passage, so that the fuel vapor adsorbed by the first and second canisters can be desorbed or purged and can then be returned into the intake air passage.

DETAILED DESCRIPTION OF THE INVENTION

Figure 1A:
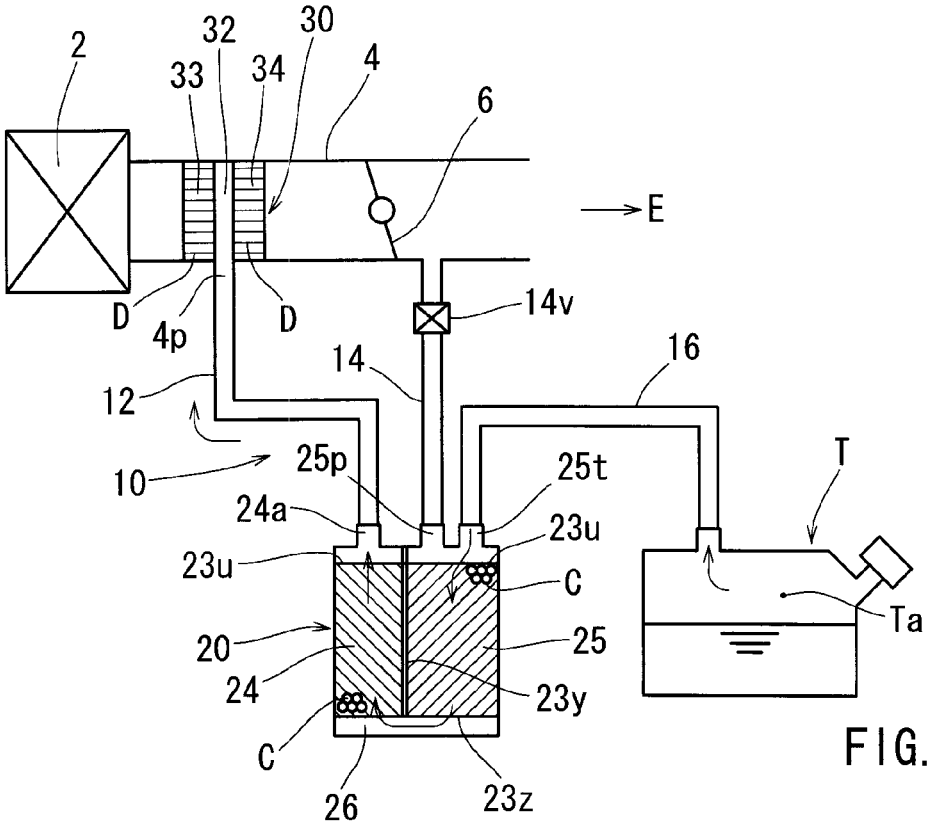
FIG. 1(A) is a schematic view of a fuel vapor processing apparatus according to a first embodiment of the present invention and showing the flow of fuel vapor during stopping of an engine.

Each of the additional features and teachings disclosed above and below may be utilized separately or in conjunction with other features and teachings to provide improved fuel vapor processing apparatus and a system incorporating the fuel vapor processing apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel vapor processing apparatus includes a main canister, a sub canister, a communication passage communicating between the main canister and the sub canister, and a purge passage communicating between the main canister and an intake air passage of an engine. The main canister can adsorb a fuel vapor that may be produced within a fuel tank. The sub canister can adsorb a part of the fuel vapor that has passed through the main canister. The sub canister is disposed within the intake air passage. During the operation of the engine, an intake air flowing through the intake air passage can (a) purge the fuel vapor adsorbed by the sub canister, (b) flow into the main canister via the communication passage, (c) purge the fuel vapor adsorbed by the main canister; and (d) return to the intake air passage via the purge passage.

With this arrangement, for example, the fuel vapor produced within the fuel tank during the stop of the engine can be first adsorbed by the main canister. A part of the fuel vapor that has passed through the main canister can be introduced into the sub canister via the communication passage, so that the fuel vapor can be adsorbed further by the sub canister.

During the operation of the engine, the intake air flowing through the intake air passage can first purge the fuel vapor adsorbed within the sub canister. After passing through the sub canister, the intake air is introduced into the main canister via the communication passage, so that the intake air can further purge the fuel vapor adsorbed within the main canister. The intake air containing the purged fuel vapor may return into the intake air passage via the purge passage.

In this way, even in the event that it is necessary to restrain the purging amount of the fuel vapor of the main canister, for example, for the reason of necessary air-fuel ratio control, it is possible to purge the fuel vapor of the sub canister by a large amount by using the flow of the intake air. Therefore, it is possible to minimize the amount of the fuel vapor remaining within the sub canister.

In another embodiment, an area of the sub canister through which the intake air flows is set to be larger than a cross sectional area of the communication passage. Therefore, it is possible to purge a large amount of the fuel vapor from the sub canister in comparison with the main canister.

In a further embodiment, a part of the intake air passage is divided into a first passage portion and a second passage portion by a partition wall extending substantially along the direction of flow of the intake air. The sub canister is disposed within the first passage portion. The communication passage may be in communication with the first passage portion. A flow control device is disposed within the first passage portion for controlling the flow of the intake air that flows out of the first passage portion and merges with the intake air flowing out of the second passage portion.

With this arrangement, by controlling the flow of the intake air flowing through the first passage portion by means of the flow control device, it is possible to adjust the flow rate of the intake air that flows through the sub canister. Therefore, it is possible to control the amount of the fuel vapor that is desorbed from the sub canister.

In a further embodiment, the first passage portion and the second passage portion receive the supply of the intake air independently of each other. With this embodiment, even in the event that an amount of the fuel vapor exceeding the capacity of the sub canister has been supplied to the sub canister and a part of the fuel vapor has been dissipated from the sub canister, it is possible to prevent the fuel vapor from flowing into the intake air passage by blocking or closing the first passage portion. Hence, it is possible to avoid such a situation that the engine is difficult to be started.

In a still further embodiment, the sub canister is configured such that the loss of pressure of the intake air flowing through the sub canister is smaller than the loss of pressure of the intake air flowing through the main canister. With this embodiment, it is possible to reduce or minimize the loss of pressure of the intake air that may be cause by the sub canister.

In a still further embodiment, a system includes a fuel tank constructed to store a fuel, an intake air passage communicating with an engine and constructed to supply an intake air to the engine, and a first canister and a second canister each configured to be able to adsorb a fuel vapor. The first canister is disposed within the intake air passage. The second canister is disposed outside of the intake air passage. A first communication passage communicates between the first canister and the second canister. A second communication passage communicates between the second canister and the intake air passage.

First Embodiment

A fuel vapor processing apparatus according to a first embodiment of the present invention will now be described with reference to FIGS. 1(A) and 1(B) and FIG. 2. The fuel vapor processing apparatus of this embodiment is adapted to be installed on a vehicle, such as an automobile.

<General Construction of Fuel Vapor Processing Apparatus>

Referring to FIG. 1, a fuel vapor processing apparatus 10 generally includes a main canister 20, a sub canister 30, a communication passage 12, a purge passage 14 and a fuel vapor passage 16. The sub canister 30 is disposed within an intake air passage 4 of a vehicle engine E. The communication passage 12 communicates between the main canister 20 and the intake air passage 4. The fuel vapor passage 16 communicates between the main canister 20 and an upper gas chamber Ta of a fuel tank T. A control valve 14*v* is disposed within the purge passage 14. The control valve 14*v* is remote-controlled by an ECU of the engine E. More specifically, the control valve 14*v* is closed during the stop of the engine E, while the degree of opening of the control valve 14*v* is controlled to suitably adjust the air-fuel ratio of the engine E during the operation of the engine E.

<Main Canister 20>

As shown in FIG. 1, the main canister 20 is configured as a substantially sealed container having an inner space. More specifically, the inner space of the main canister 20 is divided into an upper chamber and a lower chamber by a lower horizontal wall 23*z* made of filtration material. The lower chamber serves as a dissipation chamber 26. The upper chamber is divided further into an auxiliary chamber 24 and a main chamber 25 positioned on the left side and the right side as viewed in FIG. 1, respectively. An adsorption material C is filled into each of the auxiliary camber 24 and the main chamber 25. The adsorption material C may be made, for example, of activated carbon, and can adsorb the fuel vapor. Purging with air can desorb the fuel vapor adsorbed by the adsorption material C.

With the adsorption material C filled into each of the auxiliary chamber 24 and the main chamber 25, an upper horizontal wall 23*u* is attached to cover the upper side of the adsorption materials C. A space is defined on the upper side of the upper horizontal wall 23 within the main canister 20. The main canister 20 has an atmospheric port 24*a*, a purge port 25*p* and a tank port 25*t*. The atmospheric port 2*a* communicates with the auxiliary chamber 24 via the upper space of the upper horizontal wall 23 and through the upper horizontal wall 23. Each of the purge port 25*p* and the tank port 25*t* communicates with the main chamber 25 via the upper space of the upper horizontal wall 23 and through the upper horizontal wall 23.

The tank port 25*t* communicates with the upper gas chamber Ta of the fuel tank T via the fuel vapor passage 16. The purge port 25*p* communicates with the intake air passage 4 via the purge passage 14 at a position on the downstream side of the throttle valve 6. The atmospheric port 24*a* communicates with the sub canister 30 via the communication passage 12.

<Sub Canister 30>

As shown in FIG. 1, the sub canister 30 is disposed within the intake air passage 4 to extend across the intake air passage 4 at a position on the upstream side of the throttle valve 6. The sub canister 30 has a container formed of an air permeable thin plate. The inner space of the container is divided into a plurality of chambers by air permeable thin plates similar to the thin plate of the container. In this embodiment, the inner space of the container is divided into three chambers, i.e., a central chamber 32, an upstream-side chamber 33 and a downstream-side chamber 34. The upstream-side chamber 33 and the downstream-side chamber 34 are positioned on the upstream side and the downstream side of the central chamber 32, respectively. An adsorption material D is filled into each of the upstream-side chamber 33 and the downstream-side chamber 34. The adsorption material D may be made of activated carbon and may be the same as the adsorption material C of the main canister 20. However, preferably, the activated carbon of the adsorption material D may be molded to have tubular or honeycomb configurations and may be oriented in the direction of flow of the intake air in order to minimize the loss of pressure of the intake air flowing though the intake air passage 4.

The sub canister 30 is positioned within the intake air passage 4 such that the central chamber 32 communicates with a branch port 4*p* of the intake air passage 4. The branch port 4*p* is connected to the communication passage 12. Therefore, the central chamber 32 communicates with the auxiliary chamber 24 of the main canister 20 via the branch port 4*p* of the intake air passage 4 and the communication passage 12.

<Operation of Fuel Vapor Processing Apparatus>

The operations of the fuel vapor processing apparatus 10 will be first described with regard to the operation during the stop of the engine E.

Figure 1B:
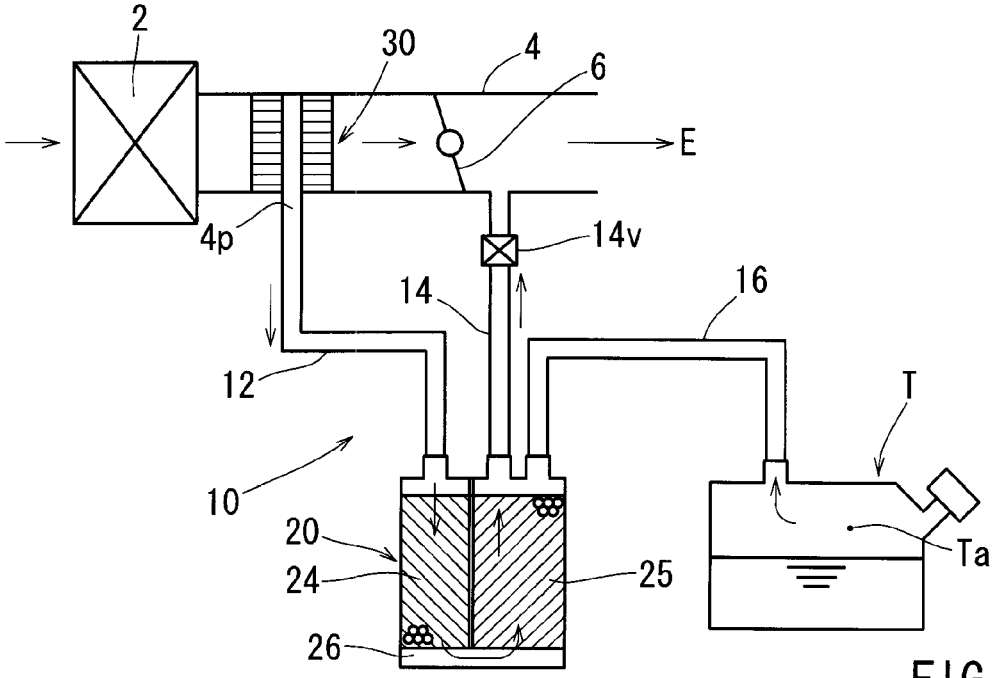
FIG. 1(B) is a schematic view similar to FIG. 1(A) but showing the flow of intake air during driving of an engine.
Figure 2:
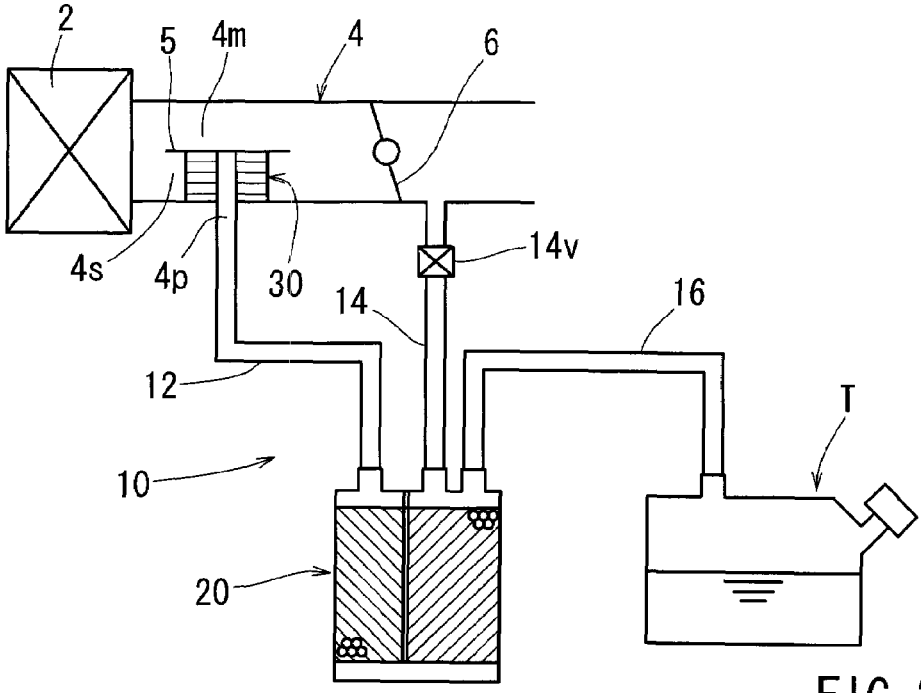
FIG. 2 is a schematic view of a fuel vapor processing apparatus according to a second embodiment of the present invention.

As indicated by arrows in FIG. 1(A), the fuel vapor produced within the fuel tank T is introduced into the fuel vapor passage 16 and further into the main chamber 25 of the main canister 20 via the tank port 25*t*, so that the fuel vapor may be adsorbed by the adsorption material C filled within the main chamber 25. An amount of the fuel vapor that has not been adsorbed by the adsorption material C of the main chamber 25 may be introduced into the auxiliary chamber 24 via the dissipation chamber 26. The control valve 14*v* is closed during the stop of the engine E, so that no fuel vapor flows into the intake air passage 4 via the purge passage 14.

The adsorption material C of the auxiliary chamber 24 can adsorb the fuel vapor that is introduced into the auxiliary chamber 24. An amount of the fuel vapor that has still not been adsorbed by the adsorption material C of the auxiliary chamber 24 may be introduced into the central chamber 32 of the sub canister 30 via the atmospheric port 24*a*, the communication passage 12 and the branch port 4*p*, so that the fuel vapor may be adsorbed by the adsorption materials D filled within the upstream-side chamber 33 and the downstream-side chamber 34. Therefore, it is possible to prevent the fuel vapor from dissipation into the atmosphere.

The operation of the fuel vapor processing apparatus 10 during the operation of the engine E will now be described. During the operation of the engine E, intake air enters into the intake air passage 4 via an air filter 2 and is then supplied to the engine E as indicated by arrows in FIG. 1(B). As the intake air flows through the sub canister 30 disposed within the intake air passage 4, the fuel vapor adsorbed by the adsorption materials D of the sub canister 30 may be purged with the intake air. In addition, during the operation of the engine E, the control valve 14*v* is opened, so that the negative pressure produced by the flow of the intake air within the intake air passage 4 may be applied to the central chamber 32 of the sub canister 30 via the purge passage 14, the main chamber 25 and the auxiliary chamber 24 of the main canister 20, and the communication passage 12. Therefore, the intake air may flow through the upstream-side chamber 33 and the downstream-side chamber 34 of the sub canister 30. The intake air containing the purged vapor fuel may then flow into the communication passage 12 via the central chamber 32 and may thereafter flow through the auxiliary chamber 24 and the main chamber 25 of the main canister 20. Hence, the fuel vapor adsorbed by the adsorption materials C of the main canister 20 may be purged with the intake air containing the fuel vapor and may be introduced into the intake air passage 4 via the purge passage 14 at a position on the downstream side of the throttle valve 6. During this operation, the degree of opening of the control valve 14*v* is controlled based on the control signal from the ECU such that the air-fuel ratio of the engine E is suitably set.

<Advantages of Fuel Vapor Processing Apparatus 10>

According to the fuel vapor processing apparatus 10 of this embodiment, during the operation of the engine E, the intake air flowing through the intake air passage 4 can purge the fuel vapor adsorbed within the sub canister 30. After purging the fuel vapor of the sub canister 30, the intake air is introduced into the main canister 20 via the communication passage 12 to purge the fuel vapor within the main canister 20. Thereafter, the intake air containing the purged fuel vapor returns to the intake air passage 4 via the purge passage 14.

In this way, because the sub canister 30 is disposed within the intake air passage 4 of the engine E, it is possible to purge the fuel vapor contained within the sub canister 30 by a large amount separately from the main canister 20. In other words, even in the case that it is necessary to restrain the amount of purging the fuel vapor contained within the main canister 20 due to the relationship with the air-fuel ratio control, it is possible to purge the fuel vapor contained within the sub canister 30 by a large amount. Hence, the remaining amount of the fuel vapor within the sub canister 30 can be reduced, and therefore, it is possible to inhibit dissipation of the fuel vapor into the atmosphere.

In addition, because the sub canister 30 extends across the intake air passage 4, the flow area of the sub canister 30 through which the intake air flows can be set to be larger than the cross sectional area of the communication passage 12. Therefore, it is possible to ensure that the fuel vapor within the sub canister 30 is purged by a larger amount in comparison with the main canister 20.

Second Embodiment

A second embodiment will now be described with reference to FIG. 2. The second embodiment is a modification of the first embodiment. Therefore, in FIG. 2, like members are given the same reference numerals as the first embodiment, and the description of these members will not be repeated. In the first embodiment, the sub canister 30 extends over the entire cross sectional area of the intake air passage 4 in the first embodiment. However, in the second embodiment, the sub canister 30 extends along a part of the cross sectional area of the intake air passage 4 in the second embodiment. More specifically, as shown in FIG. 2, a portion of the intake air passage 4 on the upstream side of the throttle valve 6 is divided into a main intake air passage 4*m* and an auxiliary intake air passage 4*s* by a partition wall 5. The partition wall 5 extends in parallel to the lengthwise direction of the intake air passage 4 along a part of the length thereof. The sub canister 30 is positioned within the auxiliary intake air passage 4*s* to extend across the same. Therefore, the sub canister 30 does not extend over the entire cross sectional area of the intake air passage 4. With this arrangement, it is possible to reduce the loss of pressure within the intake air passage 4 in comparison with the arrangement of the first embodiment shown in FIG. 1.

Third Embodiment

Figure 3:
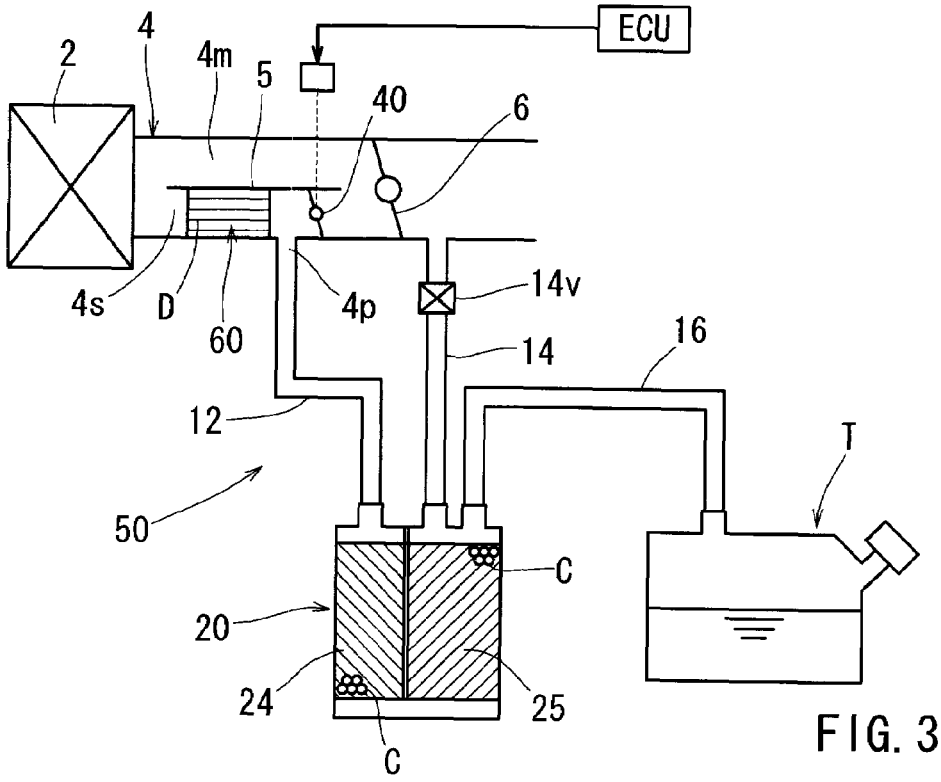
FIG. 3 is a schematic view of a fuel vapor processing apparatus according to a third embodiment of the present invention.

A third embodiment will now be described with reference to FIG. 3. The third embodiment is a modification of the second embodiment and is different from the second embodiment in the construction of the sub canister 30 and the connecting point of the communication passage 12 (i.e., the position of the branch port 4*p*). In addition, the third embodiment is different from the second embodiment in the incorporation of a flow control valve 40 disposed at the downstream-side end of the auxiliary intake air passage 4*s*.

More specifically, according to a fuel vapor processing apparatus 50 of this embodiment, a sub canister 60 does not include the central chamber 32 that is provided in the canister 30 of the previously described embodiments. Instead, an adsorption material D is filled within a container having a single chamber. The sub canister 60 is positioned within the auxiliary intake air passage 4*s* to extend across the same. The branch port 4*p* opens into the auxiliary intake air passage 4*s* at a position on the downstream side of the sub canister 60 and communicates with the communication passage 12. The flow control valve 40 is disposed on the downstream side of the branch port 4*p* and serves to control the flow rate of the intake air that flows through the auxiliary intake air passage 4*s*. The flow control valve 40 operates based on a control signal from the ECU so that the flow control valve 40 is fully closed during the stop of the engine E, and that the degree of opening of the flow control valve 40 changes to suitably set the air-fuel ratio is suitably set during the operation of the engine E.

<Operation of Fuel Vapor Processing Apparatus>

The operation of the fuel vapor processing apparatus 50 according to the third embodiment will now be described. During the stop of the engine E, the control valve 14*v* of the purge passage 14 and the flow control valve 40 of the auxiliary intake air passage 4*s* are both fully closed. In this state, fuel vapor produced within the fuel tank T may be introduced into the main chamber 25 and the auxiliary chamber 24 of the main canister 20, so that the adsorption materials C filled within the main chamber 25 and the auxiliary chamber 24 may adsorb the fuel vapor. An amount of the fuel vapor that has not been adsorbed by the adsorption materials C of the main chamber 25 and the auxiliary chamber 24 is introduced into the auxiliary intake air passage 4*s* via the communication passage 12 and the branch port 4*p*, so that the fuel vapor is adsorbed by the adsorption material D of the sub canister 60. Therefore, it is possible to prevent the fuel vapor from dissipating into the atmosphere.

During the operation of the engine E, the degree of opening of each of the flow control valve 40 of the auxiliary intake air passage 4*s* and the control valve 14*v* of the purge passage 14 is adjusted based on the control signal from the ECU. Therefore, a part of the intake air flowing into the intake air passage 4 from the air filter 2 for supplying to the engine E may flow through the auxiliary intake air passage 4*s* in which the sub canister 60 is disposed. Thus, the intake air flows through the sub canister 60 to purge the fuel vapor adsorbed by the adsorption material D of the sub canister 60. After flowing through the sub canister 60, the intake air containing the purged fuel vapor may leave the auxiliary intake air passage 4*s* via the flow control valve 40. The degree of opening of the control valve 40 may be controlled based on the control signal from the ECU, so that the air-fuel ratio of the engine E can be suitably set.

In addition, during the operation of the engine E, the negative pressure within the intake air passage 4 is applied to the auxiliary intake air passage 4*s* via the purge passage 14, the main chamber 25 and the auxiliary chamber 24 of the main canister 20, and the communication passage 12. Therefore, the intake air containing the fuel vapor that has passed through the sub canister 60 may enter the communication passage 12 and may flow further through the auxiliary chamber 24 and the main chamber 25 of the main canister 20. Hence, the fuel vapor adsorbed by the adsorption materials C of the main canister 20 may be purged and may then be introduced into the intake air passage 4 via the purge passage 14. During this operation, the control valve 14*v* may be controlled based on the control signal from the ECU, so that the air-fuel ratio of the engine E can be suitably set. Thus, the control valves 40 and 14*v* are controlled by the ECU to achieve a suitable air-fuel ratio.

In this way, according to the fuel vapor processing apparatus of this embodiment, the flow control valve 40 serves to control the flow of the intake air flowing through the auxiliary intake air passage 4*s*, which merges with the main intake air passage 4*m*. Therefore, it is possible to control the flow rate of the intake air flowing through the sub canister 60. Hence, it is possible to control the amount of the fuel vapor that is purged or desorbed from the sub canister 60.

Fourth Embodiment

Figure 4:
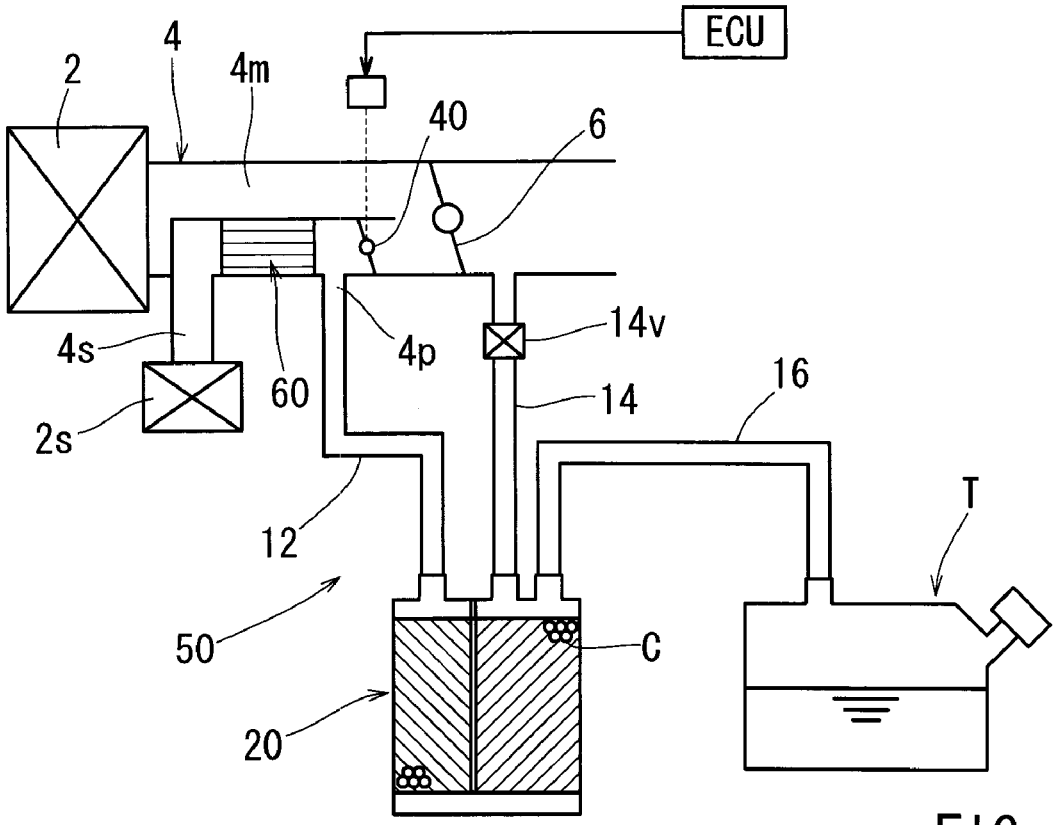
FIG. 4 is a schematic view of a fuel vapor processing apparatus according to a fourth embodiment of the present invention.
Figure 5:
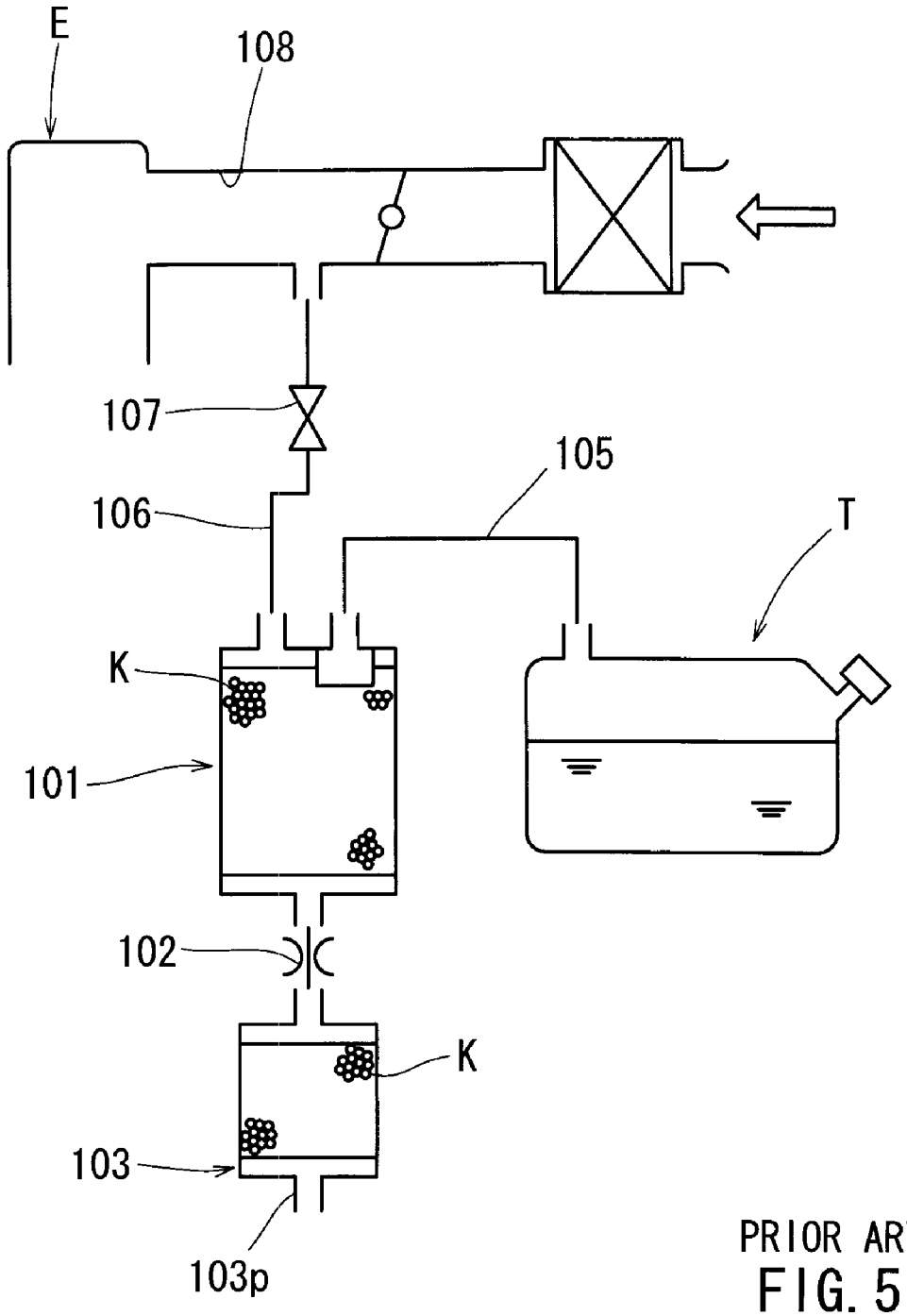
PRIOR ART FIG. 5
FIG. 5 is a schematic view of a known fuel vapor processing apparatus.

A fourth embodiment will now be described with reference to FIG. 4. The fourth embodiment is a modification of the third embodiment and is different from the third embodiment in that an auxiliary air filter 2*s* is connected to the auxiliary intake air passage 4*s* for the supply of the intake air into the auxiliary intake air passage 4*s*, while the air filter 2 supplies the intake air into the main intake air passage 4*m*. In other words, the main intake air passage 4*m* and the auxiliary intake air passage 4*s* receive the supply of the intake air independently of each other.

If an amount of the fuel vapor that exceeds the adsorption capacity of the sub canister 60 is supplied to the sub canister 60, a part of the fuel vapor that may not be adsorbed by the sub canister 60 and may flow through the sub canister 60 without being adsorbed. However, during the stop of the engine E, the flow control valve 40 is closed, and therefore, the fuel vapor may not flow from the auxiliary intake air passage 4*s* into a portion of the intake air passage 4 on the downstream side of the auxiliary intake air passage 4*s*. Therefore, the fuel vapor may cause a problem that the engine E is difficult to be started.

This invention claims:

1. A fuel vapor processing apparatus comprising:

a main canister constructed to adsorb a fuel vapor produced within a fuel tank;

a sub canister constructed to adsorb a part of the fuel vapor that has passed through the main canister, a communication passage communicating between the main canister and the sub canister; and a purge passage communicating between the main canister and an intake air passage of an engine; wherein:

the sub canister is disposed within the intake air passage, and during the operation of the engine, an intake air flowing through the intake air passage can (a) purge the fuel vapor adsorbed by the sub canister, (b) flow into the main canister via the communication passage, (c) purge the fuel vapor adsorbed by the main canister, and (d) return to the intake air passage via the purge passage.

2. The fuel vapor processing apparatus as in claim 1, wherein an area of the sub canister through which the intake air flows is set to be larger than a cross sectional area of the communication passage.

3. The fuel vapor processing apparatus as in claim 1, wherein:

a part of the intake air passage is divided into a first passage portion and a second passage portion by a partition wall extending substantially along the direction of flow of the intake air; and the sub canister is disposed within the first passage portion.

4. The fuel vapor processing apparatus as in claim 3, wherein:

the communication passage is in communication with the first passage portion; and the fuel vapor processing apparatus further comprises a flow control device disposed within the first passage portion and constructed to control the flow of the intake air that flows out of the first passage portion and merges with the intake air flowing out of the second passage portion.

5. The fuel vapor processing apparatus as in claim 3, wherein the first passage portion and the second passage portion receive the supply of the intake air independently of each other.

6. The fuel vapor processing apparatus as in claim 1, wherein the sub canister is configured such that the loss of pressure of the intake air flowing through the sub canister is smaller than the loss of pressure of the intake air flowing through the main canister.

7. A system comprising:

a fuel tank constructed to store a fuel;

an intake air passage communicating with an engine and constructed to supply an intake air to the engine;

a first canister and a second canister each configured to be able to adsorb a fuel vapor;

wherein the first canister is disposed within the intake air passage;

wherein the second canister is disposed outside of the intake air passage;

a first communication passage communicating between the first canister and the second canister; and a second communication passage communicating between the second canister and the intake air passage.

8. The system as in claim 7, further comprising a throttle valve disposed within the intake air passage, so that the intake air flows through the intake air passage from an upstream side of the throttle valve toward a downstream side of the throttle valve; wherein:

the first canister is disposed on the upstream side of the throttle valve; and the second communication passage communicates with the intake air passage at a position on the downstream side of the throttle valve.

9. The system as in claim 8, further comprising a first control valve disposed within the second communication passage, wherein the first control valve is controlled in response to change of condition of the engine.

10. The system as in claim 8, wherein:

a portion of the intake air passage on the upstream side of the throttle valve is divided into a first passage portion and a second passage portion by a partition extending substantially along the direction of flow of the intake air; and the first canister is disposed within the first passage portion.

11. The system as in claim 10, wherein:

the first communication passage communicates with the first passage portion of the intake air passage at a first position on the downstream side of the first canister.

12. The system as in claim 11, further comprising a second control valve disposed within the first passage portion at a second position on the downstream side of the first position.

13. The system as in claim 12, wherein the first passage portion and the second passage portion are configured to receive the supply of the intake air independently of each other.

14. A system comprising:

a fuel tank constructed to store a fuel;

an intake air passage communicating with an engine and constructed to supply an intake air to the engine;

a throttle valve disposed within the intake air passage, so that the intake air flows from an upstream side of the throttle valve toward a downstream side of the throttle valve;

a first canister configured to be able to adsorb a fuel vapor and disposed within the intake air passage at a first position on the upstream side of the throttle valve;

a first communication passage communicating between the first canister and the fuel tank; and a second communication passage communicating between the first canister and the intake air passage at a second position on the downstream side of the throttle valve.

15. The system as in claim 14, further comprising a second canister constructed to be able to adsorb the fuel vapor, wherein:

the second canister is disposed within the first communication passage; and the second communication passage includes a passage portion connecting between the second canister and the intake air passage.

16. The system as in claim 15, wherein the first canister comprises:

a central chamber; and an upstream side chamber and a downstream side chamber disposed on an upstream side and a downstream side of the central chamber, respectively, and each containing a fuel vapor adsorption material;

wherein the first communication passage communicates with the central chamber.

17. The system as in claim 16, wherein the first canister extends across the intake air passage over the entire cross sectional area of the intake air passage.

18. The system as in claim 14, wherein the first canister extends across a part of the cross sectional area of the intake air passage.

* * * * *